US007699508B2

(12) United States Patent
Schroeder

(10) Patent No.: US 7,699,508 B2
(45) Date of Patent: Apr. 20, 2010

(54) POLE-SUSPENDED FLAG ILLUMINATION

(76) Inventor: Karl Siegfried Schroeder, 6822 Salem Ave., Clayton, OH (US) 45315

( * ) Notice: Subject to any disclaimer, the term of this patent is extended or adjusted under 35 U.S.C. 154(b) by 0 days.

(21) Appl. No.: 12/467,490

(22) Filed: May 18, 2009

(65) Prior Publication Data

US 2009/0290365 A1 Nov. 26, 2009

Related U.S. Application Data

(60) Provisional application No. 61/128,606, filed on May 23, 2008.

(51) Int. Cl.
*F21S 8/00* (2006.01)

(52) U.S. Cl. ..... 362/431; 116/173

(58) Field of Classification Search ..... 362/183, 362/431, 382, 253, 234, 363; 116/173, 174
See application file for complete search history.

(56) References Cited

U.S. PATENT DOCUMENTS

| | | | | |
|---|---|---|---|---|
| 1,788,157 | A | | 1/1931 | Hogan |
| 3,476,929 | A | * | 11/1969 | Klinger ..... 362/307 |
| 3,752,975 | A | | 8/1973 | Meyer |
| 3,833,800 | A | | 9/1974 | Stewart et al. |
| 3,959,645 | A | | 5/1976 | Patry |
| 4,115,845 | A | | 9/1978 | Blahut |
| 4,228,487 | A | | 10/1980 | Hesse et al. |
| 4,228,489 | A | | 10/1980 | Martin |
| 4,236,193 | A | | 11/1980 | Brandt |
| 4,237,530 | A | | 12/1980 | Murray et al. |
| 4,319,312 | A | | 3/1982 | deVos et al. |
| 4,449,169 | A | | 5/1984 | Warshawsky |
| 4,527,225 | A | | 7/1985 | Hartman |
| 4,590,883 | A | | 5/1986 | Steed et al. |
| 4,972,794 | A | | 11/1990 | Smyly, Sr. |
| 5,056,545 | A | | 10/1991 | Spaeth |
| 5,105,350 | A | | 4/1992 | Tolman et al. |
| 5,357,413 | A | | 10/1994 | Mandall |
| 5,597,226 | A | | 1/1997 | Fast |
| 5,601,274 | A | | 2/1997 | Minor et al. |
| 5,615,946 | A | | 4/1997 | Yeh |
| 5,695,279 | A | | 12/1997 | Sonnleitner et al. |
| 5,988,100 | A | | 11/1999 | Schmitt |
| 6,155,696 | A | | 12/2000 | Winton et al. |
| 6,227,683 | B1 | | 5/2001 | Tukia |
| 6,659,616 | B1 | | 12/2003 | Bilotti |
| 6,682,204 | B2 | | 1/2004 | Mullally et al. |

(Continued)

*Primary Examiner*—Stephen F Husar
*Assistant Examiner*—James W Cranson
(74) *Attorney, Agent, or Firm*—Hensley Kim & Holzer, LLC

(57) ABSTRACT

A pole-suspended flag illumination system positions a lighting fixture located in close proximity to a flag on a flagpole to provide illumination to the flag. The lighting fixture can slide up and down the flagpole in unison the flag using the same halyard that is used for the flag, or by other means. Further, flags often rotate about the flagpole as the wind shifts. As such, the lighting fixture can rotate about the flagpole in alignment with the flag so as to maintain illumination on the flag at it rotates. The flag and the lighting fixture may be attached to a reinforced electrical cable that acts as a halyard and raises and lowers them both along the flagpole. Further, the electrical cable can be connected to a power source to power directional lights in the lighting fixture and any other electrical devices on the flagpole.

20 Claims, 8 Drawing Sheets

U.S. PATENT DOCUMENTS 6,955,456 B2 * 10/2005 Schroeder ..... 362/431
7,082,889 B2 8/2006 Clark
D535,584 S 1/2007 Garrett
7,275,495 B2 * 10/2007 Lawrence et al. ..... 116/174
2004/0213004 A1 10/2004 Swee et al.

* cited by examiner

POLE-SUSPENDED FLAG ILLUMINATION

CROSS-REFERENCE TO RELATED APPLICATIONS

The present application claims benefit of priority to U.S. Provisional Patent Application No. 61/128,606, entitled "Method of Illuminating a Pole Suspended Flag" and filed on May 23, 2008, specifically incorporated by reference herein for all that it discloses or teaches.

BACKGROUND

According to the Federal Flag Code Amendment Act of 2007, codified in 4 U.S.C 1, Section 6(a): "It is the universal custom to display the flag only from sunrise to sunset on buildings and on stationary flagstaffs in the open. However, when a patriotic effect is desired, the flag may be displayed 24 hours a day if properly illuminated during the hours of darkness." Although not governed by Federal Statute, illumination of other flags, including State flags, organizational flags, advertisement flags, marine flags, etc., is also of interest to groups for various personal, civic, legal, and commercial purposes.

As such, many methods and systems for illuminating a flag have been developed. One common method of illuminating a flag is to position one or more lights at the base of a flagpole, directed to illuminate the flag near the top of the flagpole with directed beams of light. However, if the flagpole is very high, the lighting power required to properly illuminate the flag is substantial and costly. Further, lighting equipment at ground level is subject to vandalism and environmental hazards (e.g., water leakage into ground-recessed lighting). An alternative lighting method is to light the flag from above using lighting affixed to the top of the flagpole. However, tall flagpoles also present a problem with maintenance for such illumination systems—obtaining access to the tops of very high flagpoles can be difficult, risky, and expensive. As such, existing approaches for illuminating flags present nontrivial challenges.

SUMMARY

Implementations described and claimed herein address the foregoing problems by providing a lighting fixture located in close proximity to the flag to provide illumination to the flag. In one implementation, the lighting fixture is moved up and down the flagpole in unison the flag using the same halyard that is used for the flag, or by other means (e.g., a separate halyard). Further, flags often rotate about the flagpole as the wind shifts. As such, the lighting fixture can rotate about the flagpole in alignment with the flag so as to maintain illumination on the flag at it rotates.

In another implementation, the flag and the lighting fixture are attached to a reinforced electrical cable that acts as a halyard and raises and lowers them both along the flagpole. Further, the electrical cable can be connected to a power source to power directional lights in the lighting fixture and any other electrical devices on the flagpole.

Other implementations are also described and recited herein.

BRIEF DESCRIPTIONS OF THE DRAWINGS

DETAILED DESCRIPTIONS

Figure 1:
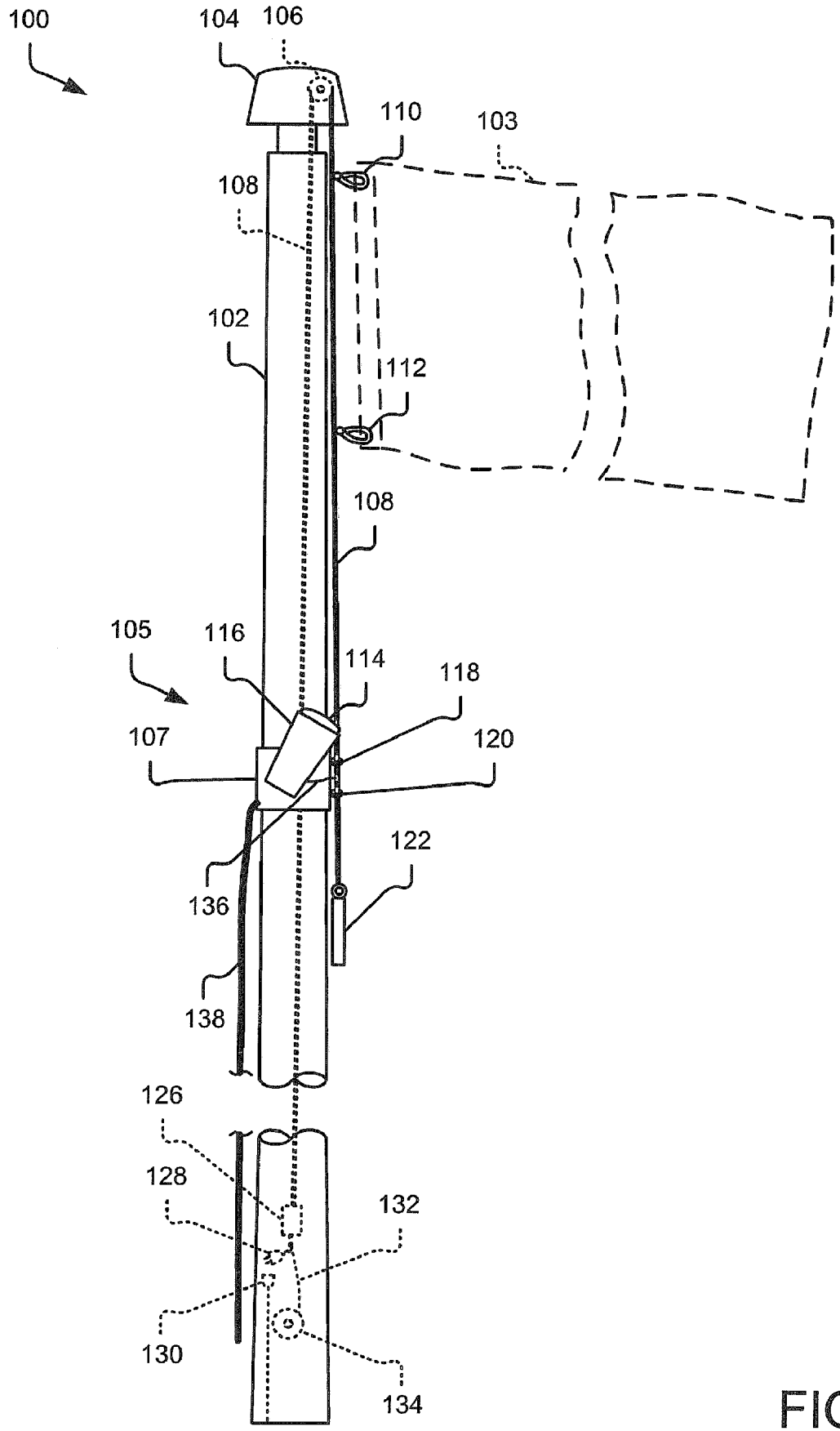
FIG. 1 illustrates an example pole-suspended flag illumination system.

FIG. 1 illustrates an example pole-suspended flag illumination system 100. A flagpole 102 stands upright, generally perpendicular to a base surface (e.g., the ground, a building roof, etc.), although various other angles may be employed. Typically, flagpoles are generally cylindrical and often have a slight tapering such that the cross-sectional diameter of the flagpole near its top is smaller than that near its bottom. Nevertheless, some flagpoles may not be tapered or may have other cross-sectional shapes. Further, some flagpoles are comprised of segments of incrementally smaller diameters stacked on top of each other, with a tapered or abrupt seam at each segment interface with another segment (see e.g., FIG. 7). In various implementations, the flagpole can be solid or "hollow" (e.g., having an open channel of some size through at least a portion of the flagpole's length).

In general, operation, a halyard 108 is internally strung to the top of the hollow flagpole 102 and then back down to an anchor point (e.g., winch 134, an anchored cable, a cleat) near the bottom of the flagpole 102. The anchored end of the halyard 108 can typically be accessed and/or manipulated by a user to raise or lower the halyard 108 and therefore lower and raise an attached flag. A flag 103 is attached to the non-anchored end of the halyard 108 (as shown in FIG. 1) by flag fasteners 110 and 112 (e.g., snap hooks that are attached to the halyard 108 and inserted through grommets at the side of the flag 103). As the non-anchored end of the halyard 108 is raised, the flag 103 raises with it along the flagpole 102. Likewise, as the non-anchored end of the halyard 108 is lowered, the flag 103 lowers along the flagpole 102.

In the illustrated implementation in FIG. 1, the halyard 108 is a reinforced electrical cable that is anchored to the winch 134 by a steel cable 132, although alternative halyards may be made from non-electrical cables, such as rope, nylon cable, etc. The winch 134 can be unwound to raise the anchored end of the halyard 108, thereby lowering the flag 103, or wound to lower the anchored end of the halyard 108, thereby raising the flag 103. The halyard 108 is threaded up the interior of the hollow flagpole 102, and at the top of the flagpole 102, the halyard 108 is threaded over a pulley 106 to descend along the outside of the flagpole 102 to support the flag 103. It should be understood that, in other implementations, both the anchored and non-anchored ends of the halyard may be positioned on the exterior of the flagpole 102 (referred to as an external halyard implementation).

The pulley 106 is positioned within a rotating mechanism 104, such as a rotating truck, that rotates about a central axis of the flagpole 102. The pulley 106 rotates about the central axis of the flagpole 102, and therefore the non-anchored end of the halyard 108, which threads through the pulley 106, rotates about the exterior of the flagpole 102 as the wind shifts the flag 103. A rotary electrical connector 126 is positioned in-line along the halyard 108 between the rotating mechanism 104 and the anchor (e.g., winch 134) to alleviate twisting of the halyard as the rotating mechanism 104 rotates with the flag 103.

In the illustrated implementation, the halyard 108 is a reinforced electrical cable with a plug 128 that is plugged into a power source (e.g., accessible by plug 130). In this manner, electrical power can be transmitted up the halyard 108 to electrical components within the illumination system, such as a lighting fixture.

One example of a lighting fixture is depicted in FIG. 1 as lighting fixture 105, which includes one or more directional lights 114 in one or more lighting sockets 116 that are attached to a collar 107. The collar 107 is attached to the non-anchored end of the halyard 108 by collar fasteners 118 and 120, such that the lighting fixture 105 can raise and lower with the non-anchored end of the halyard 108. The lighting fixture 105 is powered by a feed cable 136 that electrically connects the lighting sockets 116 to the electrical cable of the halyard 108. In one implementation, a weight 122 is attached to the non-anchored end of the halyard 108 to assist in lowering the lighting fixture 105 and the flag 103 when the non-anchored end of the halyard 108 is lowered. For example, the weight 122 can be helpful to overcome frictional resistance of the collar 107 sliding against the exterior of the flagpole 102. Alternatively or additionally, a weight can be attached to the lighting fixture 105 to provide similar effect. Further, the lighting fixture 105 may be heavy enough to alleviate any need for supplemental weighting in some implementations. In yet another implementation, as shown in FIG. 1, a secondary halyard 138 may be employed to assist in sliding the lighting fixture 105 down the flagpole 102, but it should be understood that in most implementations, proper weighting and/or collar-flagpole friction reduction should eliminate any need for a secondary halyard 138.

Figure 2:
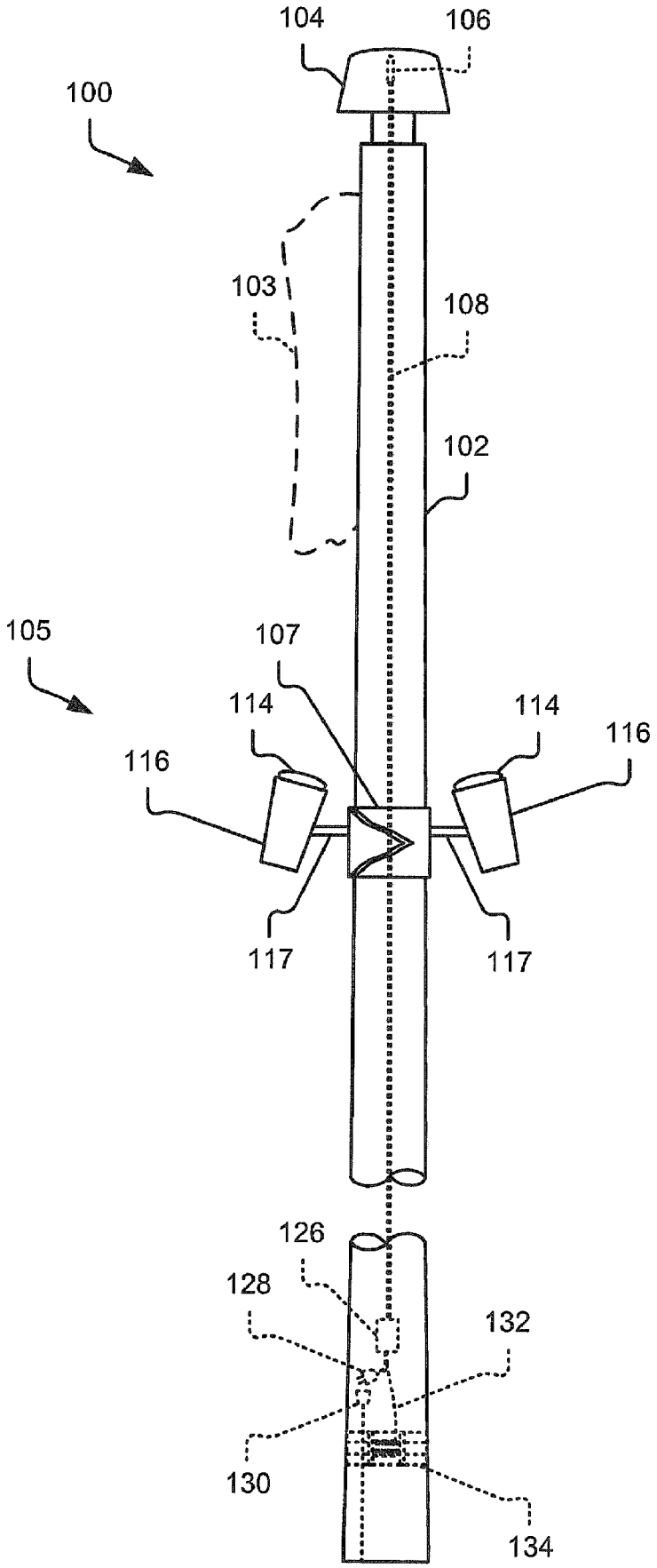
FIG. 2 illustrates another view of the example pole-suspended flag illumination system.

FIG. 2 illustrates another view of the example pole-suspended flag illumination system 100. The view represents a 90° rotation of the example pole-suspended illumination system 100 from FIG. 1. The flagpole stands upright generally perpendicular to a base surface, although various other angles maybe employed. The halyard 108 is internally strung to the top of the hollow flagpole 102 and then back down to an anchor point (e.g., winch 134) near the bottom of the flagpole 102, although the exterior, non-anchored end of the halyard is not visible in FIG. 2. A flag 103 is attached to the non-anchored end of the halyard 108 (as shown in FIG. 1). As the non-anchored end of the halyard 108 is raised, the flag 103 raises with it along the flagpole 102. Likewise, as the non-anchored end of the halyard 108 is lowered, the flag 103 lowers along the flagpole 102.

In the illustrated implementation in FIG. 1, the halyard 108 is a reinforced electrical cable that is anchored to the winch 134 by a steel cable 132. The winch 134 can be unwound to raise the anchored end of the halyard 108, thereby lowering the flag 103, or wound to lower the anchored end of the halyard 108, thereby raising the flag 103. The halyard 108 is threaded up the interior of the hollow flagpole 102, and at the top of the flagpole 102, the halyard 108 is threaded over a pulley 106 to descend along the outside of the flagpole 102 to support the flag 103. It should be understood that, in other implementations, both the anchored and non-anchored ends of the halyard may be positioned on the exterior of the flagpole 102 (referred to as an external halyard implementation).

The pulley 106 is positioned within a rotating mechanism 104, such as a rotating truck, which allows the pulley 106, and therefore the non-anchored end of the halyard 108 to rotate about the exterior of the flagpole 102 as the wind shifts the flag 103. A rotary electrical connector 126 is positioned in-line along the halyard 108 between the rotating mechanism 104 and the anchor (e.g., winch 134) to alleviate twisting of the halyard as the rotating mechanism 104 rotates with the flag 103.

In the illustrated implementation, the halyard 108 is a reinforced electrical cable with a plug 128 that can be plugged into a power source (e.g., accessible by plug 130). In this manner, electrical power can be transmitted up the halyard 108 to electrical components within the illumination system, such as a lighting fixture. It should be understood, however, that an alternative halyard may be made from a non-electrical rope, cable, etc. and that power is supplied to the lighting fixture 105 by other means, such as a separate power cable that is strung internally or externally along the flagpole 102.

In FIG. 2, the lighting fixture 105 is shown with two directional lights 114, each light installed in the lighting socket 116 that is attached to the collar 107 by a crossbar 117. The lighting fixture 105 can support any number of one or more lights. For particularly large flags, multiple directional lights on both sides of the flag may provide brighter and more uniform illumination over the entire flag. The lighting fixture 105 is powered by a feed cable 136 that electrically connects the lighting sockets 116 to the electrical cable of the halyard 108. The feed cable 136 can be threaded through or along the crossbar 117 to each lighting socket 116.

Figure 6:
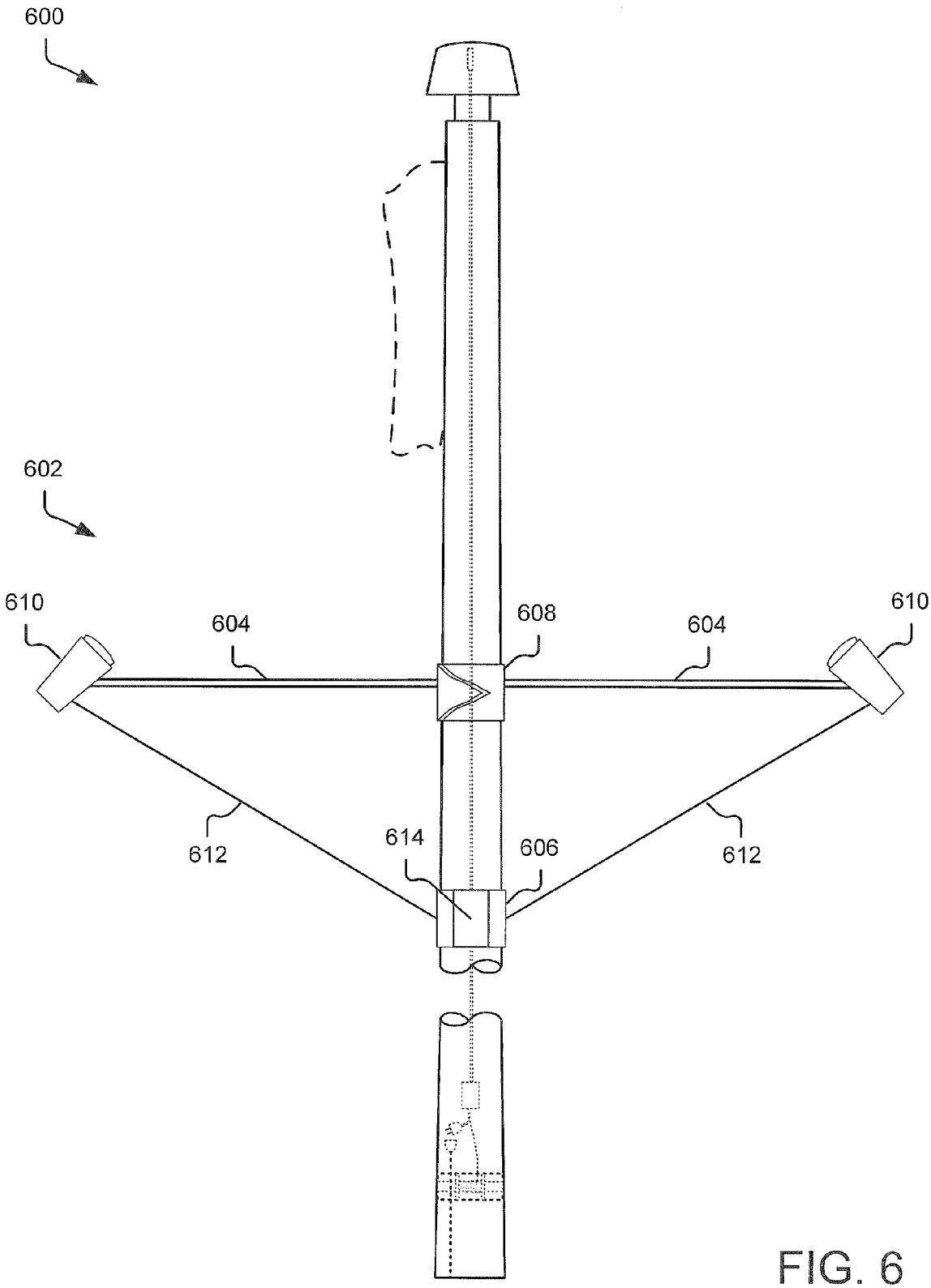
FIG. 6 illustrates an alternative implementation of an example pole-suspended flag illumination system.

The collar 107 shown in FIGS. 1 and 2 is a tension collar that is flexible yet resilient and is designed to accommodate the tapering of the flagpole 102. Generally, a tension collar includes an expandable mounting that provides a relatively consistent loose fit or a relatively consistent snug fit against the flagpole at varying diameters. A consistent loose fit can provide acceptable stability for the lighting fixture 105 along the length of the flagpole 102 in some configurations, particularly as the flagpole tapers along its length. Tighter fits may be used to provide additional stability against vibrations and rocking of the lighting fixture 105, while still allowing sliding and/or rotating of the lighting fixture 105 on the flagpole 102. The height and tightness of the tension collar 107 can be adjusted to stabilize various configurations of lighting systems. For example, a tension collar 107 supporting a wide light span (e.g., the crossbars 117 are longer, allowing a wider separation of the lights 114) may have a longer surface area against the flagpole 102 to stabilize the longer moment arms introduced by the longer crossbars). FIG. 6 illustrates an alternative implementation for stabilizing a wide light span.

In one implementation, the tension collar 107 is split in a sideways "V" cut to form a "split collar", as shown, although other configurations are contemplated (e.g., an interlocking "comb" cut). The "V" cut provides a wide range of expansion and contraction of the tension collar 107 to maintain a snug fit against the flagpole 102 at different pole diameters without expanding so much that the collar 107 slips off the flagpole 102. Furthermore, the tension collar 107 may be opened up enough to fit around the flagpole 102 and then contract back against the flagpole 102 for the snug fit.

The tension collar 107 in FIGS. 1 and 2 is rotatably and slidingly mounted against the flagpole 102 at various diameters of the flagpole 102 and is externally attached to the halyard 108 in alignment with the flag fasteners 110 and 112 so that the tension collar 107 rotates about the flagpole 102 as the flag 103 shifts around the flagpole 102 when the wind shifts. Furthermore, the tension collar 107 is rotatably and slidingly mounted against the flagpole 102 to allow the tension collar 107 to raise with the flag fasteners 110 and 112 (and therefore the flag 103) as the non-anchored end of the halyard 108 is raised and to lower with the flag fasteners 110 and 112 (and therefore the flag 103) as the non-anchored end of the halyard 108 is lowered. The weight 122 shown in FIG. 1 further assists in dragging the tension collar 107 down the flagpole 102 as the non-anchored end of the halyard 108 is lowered.

In summary, the flag fasteners 110 and 112 (and therefore the flag 103) and the collar 107 (and therefore the lighting fixture 105) move up and down along the flagpole 102 in unison and rotate about the central axis of the flagpole 102 to maintain illumination on the flag 103 during operation. Further, the halyard 108 may constitute an electrical cable that raises and lowers the flag 103 and lighting fixture 104 in unison, rotates the flag 103 and lighting fixture 105 in unison, and powers the lighting fixture 105 based on an electrical connection to a power supply at the bases of the flagpole 102. Various alternative configurations of this illuminations system are also described and claimed herein.

It should be understood that other implementations may be employed. For example, one alternative implementation employs an electrical cable to power the lighting fixture and a separate halyard to raise and lower the flag and the lighting fixture in unison. In this implementation, the electrical cable can descend down the interior and/or exterior of the flagpole to a power source. The lighting fixture slides up and down the flagpole on the separate halyard and may rotate in alignment with the flag, although in some implementations, sliding without rotating is sufficient.

Figure 3:
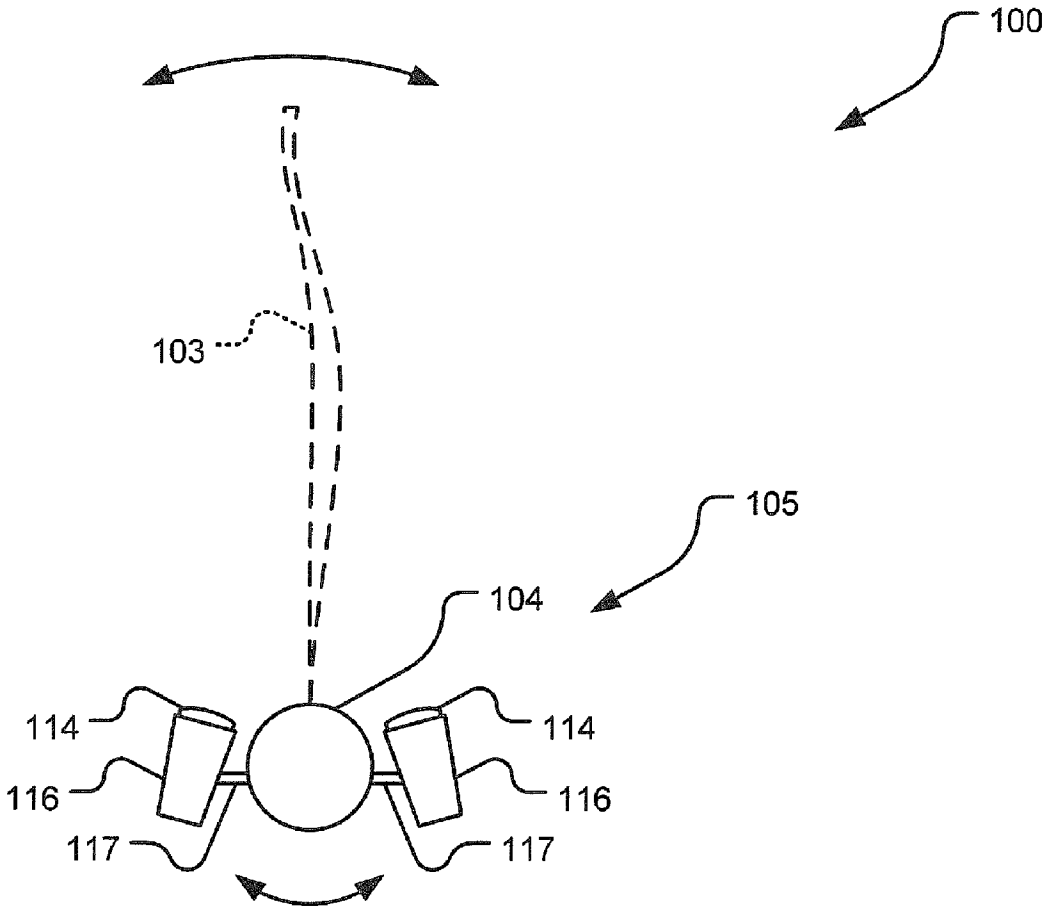
FIG. 3 illustrates a top view of the example pole-suspended flag illumination system.

FIG. 3 illustrates a top view of an example pole-suspended flag illumination system 100. The flagpole 102 is obscured in this view by the rotating mechanism 104, but it should be understood that the flagpole 102 extends into the drawing page of FIG. 3. The lighting fixture 105 is rotatably and slidingly mounted to the flagpole 102 by a tension collar 107 (not shown in FIG. 3). The crossbars 117 are shown extending from the obscured location where the tension collar 107 is positioned to support lighting sockets 116 and lights 114. The flag 103 is shown extending from the flagpole 102.

A wind can catch the flag 103 and extend the flag 103 radially from the flagpole 102. As the winds shifts, the flag 103 shifts accordingly, thereby shifting about the central axis of the flagpole 102. Because the flag 103 and lighting fixture 105 are attached to the same halyard and because the lighting fixture 105 is rotatably mounted to the flagpole 102 by the tension collar 107 (not shown in FIG. 3) in alignment with the flag fasteners 110 and 112, the lighting fixture 105 rotates about the central axis of the flagpole 102 with the flag 103 to maintain alignment of the lights 114 with the flag 103. The automatic alignment between the lighting fixture 105 and the flag 103 provides effective lighting of the flag 103 as the wind shifts.

Figure 4:
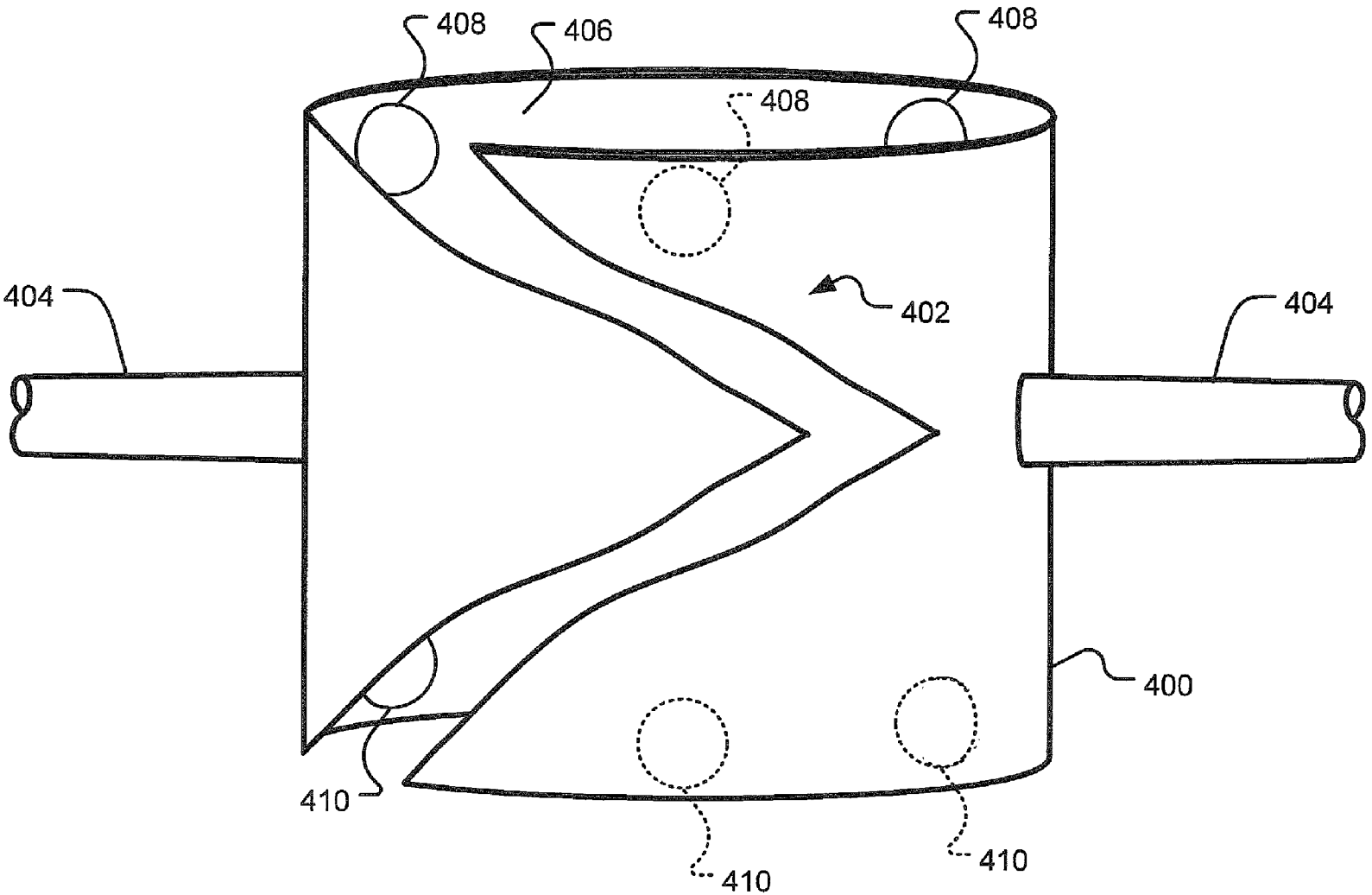
FIG. 4 illustrates an example tension collar of a pole-suspended flag illumination system.

FIG. 4 illustrates an example tension collar 400 of a pole-suspended flag illumination system. The tension collar 400 may be constructed from various materials, including polyvinyl chloride (PVC) and stainless steel. Crossbars 404 extend from the tension collar 400 to support lighting sockets (not shown in FIG. 4) and lights (not shown in FIG. 4). The crossbars 404 are shown in FIG. 4 as extending radially from the tension collar 400 at an angle of 180° from each other. However, it should be understood that the crossbars 404 may extend at any angle and position from the tension collar 400 to provide an appropriate alignment between the lights and the flag (e.g., the lights are aligned to illuminate across the full width and height of the flag).

The tension collar 400 illustrated in FIG. 4 is a split collar that allows an installer to open the tension collar 400 along the "V" cut 402 and enclose the tension collar about a flagpole so that the interior surface 406 of the tension collar 400 mounts against the exterior flagpole surface. The interior surface 406 is smooth enough to allow the tension collar 400 to slide up and down along the exterior flagpole surface and to rotate about the flagpole as the wind shifts the flag.

In one implementation, the interior surface 406 of the tension collar 400 is smooth and directly contacts the exterior surface of the flagpole when mounted. In this configuration, the friction between the tension collar 400 and the flagpole is small enough to still allow sliding and rotating, particularly if the tension collar 400 fits loosely around the flagpole. In other implementations, such as that shown in FIGS. 4 and 5, dedicated contact points 408 and 410 (e.g., bearing balls, ridges, hemispherical knobs, bumps, etc.) may be added to the interior surface 406 to reduce the surface area of the interior surface 406 contacting the exterior surface of the flagpole or to otherwise assist in the sliding and rotating characteristics. In this manner, the friction between the tension collar 400 and the flagpole can be minimized, thereby facilitating sliding and rotating. In the illustrated implementation, contact points constituting hemispherical knobs are employed to provide easy sliding and rotating (i.e., movement in multiple dimensions along the flagpole), although other contact points are also contemplated.

In some implementations, placement of the contact points 408 and 410 at least near the top and bottom of the tension collar 400 (as shown in FIG. 4) can improve the stability of the lighting fixture by widening the fit against the flagpole. The contact points 408 and 410 in FIG. 4 are positioned at 120° about the inner circumference of the tension collar 400, although other contact point numbers and spacings may be employed.

Although the tension collar 400 is shown as a cylindrical configuration, it should also be understood that the interior surface 406 of the tension collar 400 may be tapered to better accommodate the tapering of a flagpole. For example, a slight machining of the interior surface 406 can taper enough to enhance the fit of the tension color 400 against a tapered flagpole.

Other tension collars are also contemplated. For example, rather than having a single collar configuration, a tension collar can have a rotating outer collar, on which the crossbars are mounted, and one or more expandable inner collars having bearing balls that contact and slide against the exterior flagpole surface. The bearing balls can further facilitate both sliding and rotating of the tension collar. A spring mechanism mounted between the outer collar and the one or more inner collars to provide tension against the exterior flagpole surface and yet allows expansion and contraction of the inner collar (s) as the flagpole diameter changes along the height of the flagpole. Other sliding and rotating tension collars are contemplated.

Figure 5:
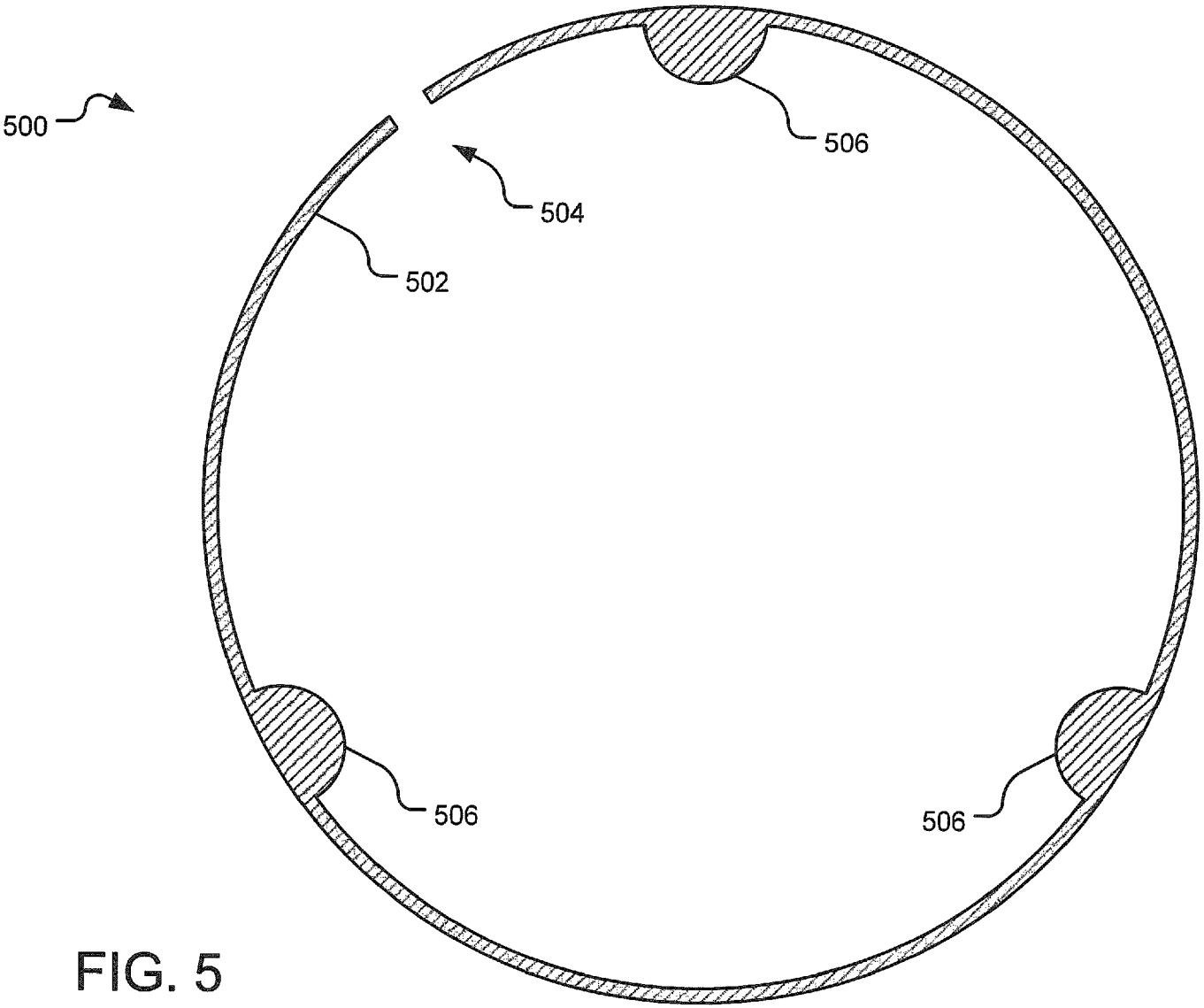
FIG. 5 illustrates a cross-sectional view of an example tension collar of a pole-suspended flag illumination system.

FIG. 5 illustrates a cross-sectional view of an example tension collar 500 of a pole-suspended flag illumination system through example three contact points. When the tension collar 500 is mounted on the flagpole, the interior surface 502 of the tension collar 500 faces the flagpole. A cut 504 represents an opening in the collar circumference introduced by the "V" cut.

Three knobs 506 are shown as contact points protruding from the interior surface 502 of the tension collar 500 and are considered part of the interior surface 502 of the tension collar 500. In this manner, the innermost surfaces of the knobs 506 will contact the exterior surface of the flagpole, providing stability while allowing sliding and rotating. The contact points 506 are spaced at 120° angles about the interior surface 502 of the tension collar 500 to provide lateral stability while reducing the number of contact points 506, but other implementations may include different numbers of contact points that can be spaced at different angles about the interior surface 502 of the tension collar 500.

Alternative contact points may be tapered or cut on the downward side of each contact point to facilitate downward sliding of the tension collar 500, particularly as the contact points slide down against seams or aberrations in the exterior surface of the flagpole. Further, contacts points may be separate from the interior surface 502 of the tension collar 500. For example, instead of or in addition to knobs, contacts points may be bearing balls set in the tension collar 500 or in other attachment points of the tension collar 500 to facilitate sliding and rotating.

FIG. 6 illustrates an alternative implementation of an example pole-suspended flag illumination system 600. A lighting fixture 602 includes longer crossbars 604, thereby introducing a longer moment arm and therefore more instability into the system. To improve the stability of the lighting fixture 602, the illumination system incorporates two collars: a lighting fixture tension collar 606 that is similar to the tension collar discussed with regard to FIGS. 1-5, with or without dedicated contact points, and a stabilizing collar 608 that is attached to the crossbars 604 and/or lighting sockets 610 by rigid or flexible tethers 612 under tension (e.g., a stabilizing downward force on the stabilizing collar 608 pulls at the crossbars 604 and/or lighting sockets 610 to provide the tension). The stabilizing collar 608 maybe loose or snug, may or may not be expandable, and is weighted (see weight 614) to provide a stabilizing downward force on the crossbars 604 and/or lighting sockets 610. The two-collar configuration also provides a longer interface with the flagpole, providing a wider base for stability against the flagpole.

Figure 7:
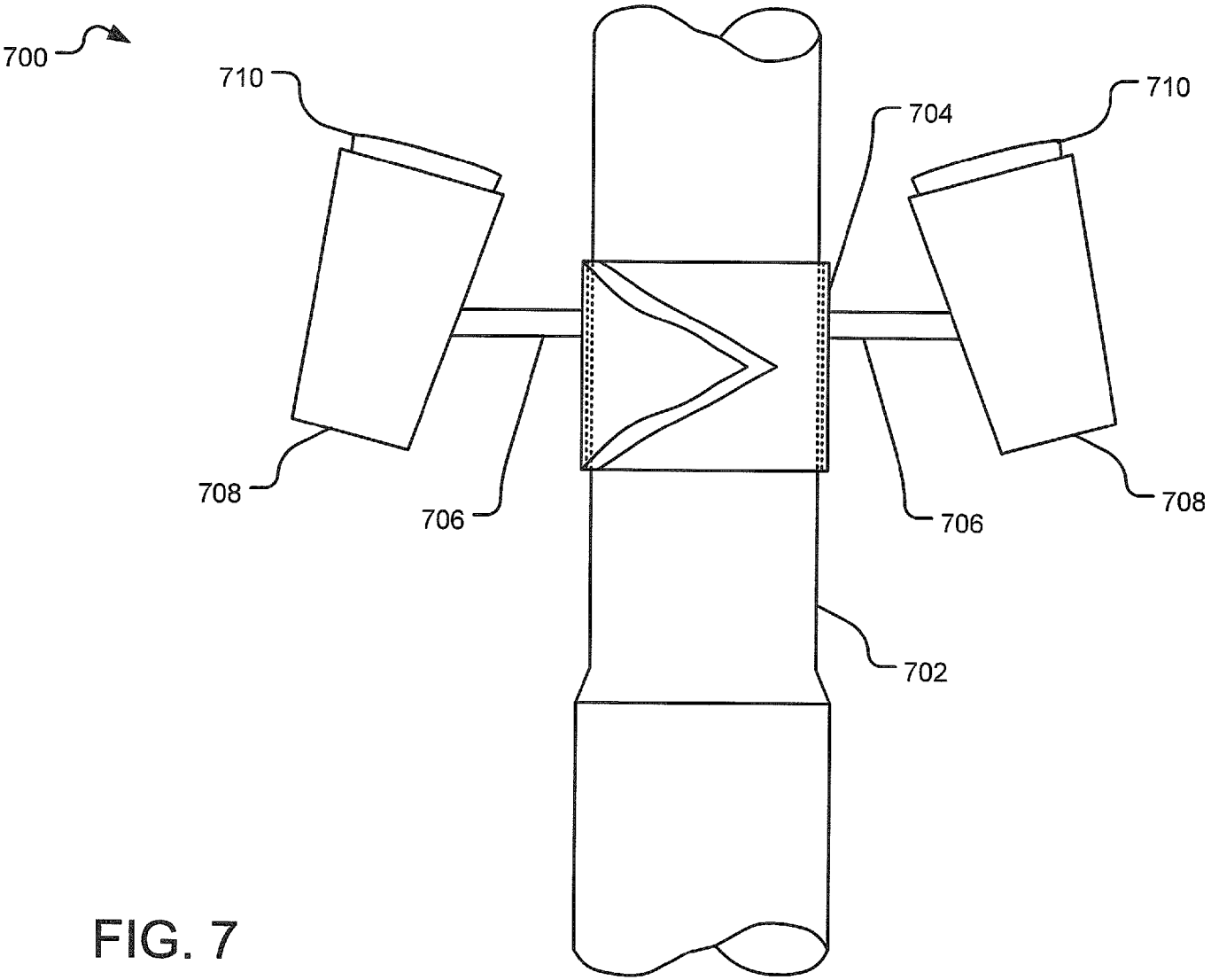
FIG. 7 illustrates an example pole-suspended lighting fixture mounted on a segmented flagpole.

FIG. 7 illustrates an example pole-suspended lighting fixture 700 mounted on a segmented flagpole 702. While the trunks of some flagpoles are built from a single piece of material (e.g., extruded aluminum, rolled steel, etc.), other flagpoles are built from segments of poles stacked on top of each other. Still other flagpoles are built from telescoping segments. The illustrated flagpole 702 shows a tapered seam between the top segment and the bottom segment, although some segmented flagpoles have abrupt seams.

The lighting fixture 700 is mounted on the segmented flagpole 702 by a tension collar 704 in a manner similar to that described previously, supporting the crossbars 706, lighting sockets 708, and lights 710. The tension collar 704 is fit against the flagpole 702 loosely enough to slide onto the tapered seam and expand to accommodate the increased circumference of the lower flagpole segment as the weight of the lighting fixture 700 (and possibly other weights—see weight 122 in FIG. 1) pulls the tension collar 704 down along the flagpole 700. The bottom portion of the interior surface of the tension collar 704 may also be tapered and/or the circumference of the bottom portion may be flared (e.g., flared to have greater interior and/or external circumference than the upper portion of the collar) to assist in the engagement of the tension collar 704 with the increased circumference of the lower flagpole segment, which can facilitate the expansion of the tension collar 704 to accommodate the increased circumference of the lower flagpole segment, particularly when the seam is abrupt (e.g., the seam has little or no taper or is a seam between two telescoping segments).

Figure 8:
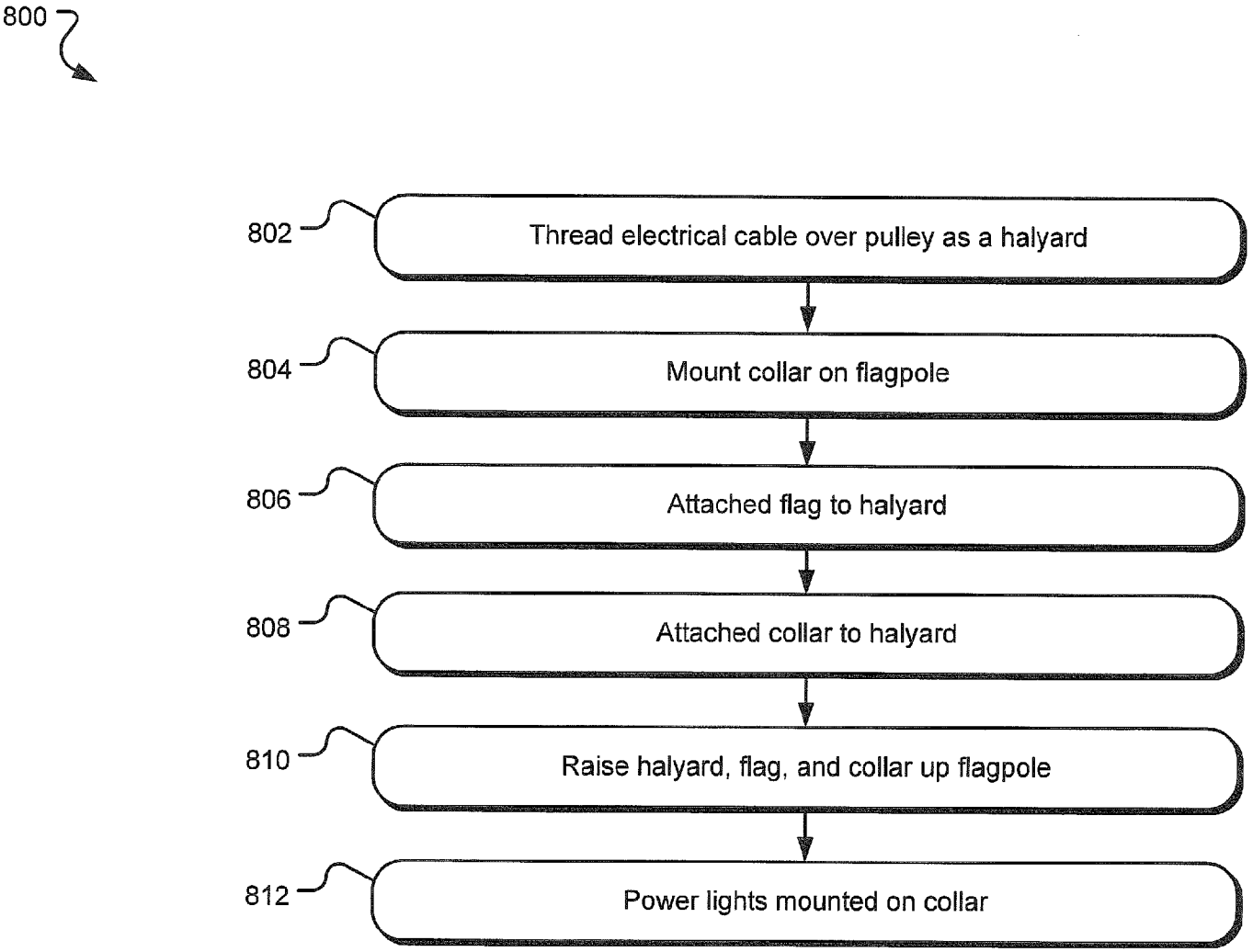
FIG. 8 illustrates example operations for lighting a flag near the top of a flagpole.

FIG. 8 illustrates example operations 800 for lighting a flag near the top of a flagpole. A threading operation 802 threads a reinforced electrical cable (or a non-electrical cable) through a pulley at the top of the flagpole to act as a halyard. The halyard may be fully external to the flagpole or at least a portion of the flagpole may travel through the interior of the flagpole, particularly to descend through the interior of a hollow flagpole to attach to an anchor (e.g., a winch). The non-anchored end of the halyard includes flag fasteners that can be attached to a flag. A mounting operation 804 attaches the lighting fixture onto the flagpole by mounting the tension collar on the flagpole.

An attaching operation 806 attaches the flag to the halyard using the flag fasteners. Another attaching operation 808 attaches the collar to the halyard, below the flag fasteners, although it should be understood that a lighting fixture may be alternatively or additionally attached above the flag fasteners in other implementations. The collar (and therefore the lighting fixture) and the flag fasteners (and therefore the flag) are attached so that they align in a manner that ensures that the lights remain directed toward the flag as the wind shifts the flag about the flagpole. A raising operation 810 raises the halyard, and therefore the flag and collar up the flagpole. A powering operation 812 connects the electrical cable halyard to a power source to provide power to the lights mounted on the collar.

When the flag is to the lowered, the operations may be executed in substantially reverse order. Further, there is no need to perform all of the illustrated application when lowering or raising the flag, and various operations may be performed in a different order (e.g., the collar may be attached to the halyard before the flag is attached to the halyard) without deviating from the described technology.

The above specification, examples, and data provide a complete description of the structure and use of exemplary embodiments of the invention. Since many embodiments of the invention can be made without departing from the spirit and scope of the invention, the invention resides in the claims hereinafter appended. Furthermore, structural features of the different embodiments may be combined in yet another embodiment without departing from the recited claims.

What is claimed is:

1. A pole-suspended flag illumination system comprising:

a halyard having an anchored end and a non-anchored end, the anchored end of the halyard being adapted to attach to an anchor point on a flagpole;

one or more flag fasteners attached to the non-anchored end of the halyard;

a lighting fixture adapted to slidingly and rotatably mount on the flagpole, the lighting fixture being attached the non-anchored end of the halyard below the one or more flag fasteners, wherein the lighting fixture is adapted to slide up and down along the flagpole and to rotate about a central axis of the flagpole in unison and in alignment with the one or more flag fasteners.

2. The pole-suspended flag illumination system of claim 1 wherein the lighting fixture includes directional lighting positioned to align with the flag fasteners, and the lighting fixture rotates about the central axis of the flagpole to maintain alignment with the flag fasteners as the flag fasteners shift about the flagpole.

3. The pole-suspended flag illumination system of claim 1 further comprising:

a weight attached to the non-anchored end of the halyard.

4. The pole-suspended flag illumination system of claim 1 further comprising:

a weight attached to the lighting fixture.

5. The pole-suspended flag illumination system of claim 1 wherein the halyard includes an electrical cable; the flag fasteners, the anchor point, and the lighting fixture are attached to the electrical cable; and the lighting fixture is powered by an electrical source connected to the electrical cable.

6. The pole-suspended flag illumination system of claim 1 wherein the halyard includes an electrical cable; the flag fasteners, the anchor point, and the lighting fixture are attached to the electrical cable; and the anchored end of the halyard is anchored within a hollow portion of the flagpole.

7. The pole-suspended flag illumination system of claim 1 wherein the anchor point includes a winch mounted on the flagpole, wherein the halyard wraps around the winch as the non-anchored end of the halyard is raised.

8. The pole-suspended flag illumination system of claim 1 wherein the lighting fixture includes a tension collar adapted to mount the lighting fixture to the flagpole, the tension collar encircling the central axis of the flagpole and the exterior of the flagpole.

9. The pole-suspended flag illumination system of claim 1 wherein the lighting fixture includes a tension collar adapted to mount the lighting fixture to the flagpole, wherein the tension collar forms a split collar that is configured to open to fit about the flagpole and to contract to substantial closure around the exterior surface of the flagpole at various flagpole diameters.

10. The pole-suspended flag illumination system of claim 1 wherein the lighting fixture includes a tension collar adapted to mount the lighting fixture to flagpole, wherein the tension collar includes a plurality of dedicated contact points protruding from the interior surface of the tension collar.

11. The pole-suspended flag illumination system of claim 1 further comprising:

a stabilizing collar adapted to slidingly and rotatably mount on the flagpole below the lighting fixture and to attach to the lighting fixture by a tether under tension.

12. A pole-suspended flag illumination system comprising:

a flagpole having a central axis;

a rotating mechanism mounted on the flagpole and adapted to rotate about a central axis of the flagpole;

a pulley attached to the rotating mechanism, wherein the pulley rotates about the central axis of the flagpole with the rotating mechanism;

a halyard threaded through the pulley and having an anchored end and a non-anchored end, the anchored end of the halyard being adapted to attach to an anchor point of a flagpole;

one or more flag fasteners attached to the non-anchored end halyard;

a lighting fixture adapted to slidingly and rotatably mount around the central axis of the flagpole, the lighting fixture being attached the non-anchored end of the halyard, wherein the lighting fixture is adapted to slide and rotate on a flagpole in unison with the one or more flag fasteners.

13. The pole-suspended flag illumination system of claim 12 wherein the lighting fixture includes a tension collar adapted to mount the lighting fixture to the flagpole, wherein the tension collar forms a split collar that is adapted to open to fit around the flagpole and contract to substantial closure against the exterior surface of the flagpole at various flagpole diameters.

14. The pole-suspended flag illumination system of claim 12 wherein the lighting fixture includes a tension collar adapted to mount the lighting fixture to the flagpole, wherein the tension collar includes a plurality of dedicated contact points protruding from the interior surface of the tension collar.

15. The pole-suspended flag illumination system of claim 12 wherein the halyard includes an electrical cable; the flag fasteners, the anchor point, and the lighting fixture are attached to the electrical cable; and the lighting fixture is powered by an electrical source connected to the electrical cable.

16. A method of illuminating a flag, the method comprising:

threading a halyard through a pulley at the top of a flagpole, the pulley being adapted to rotate about a central axis of the flagpole;

anchoring one end of the halyard to an anchor point of the flagpole;

mounting a lighting fixture on the flagpole, wherein the lighting fixture is rotatable about the central axis of the flagpole and is slidable against the exterior surface of the flagpole along the central axis of the flagpole;

attaching the lighting fixture and a flag in alignment with each other to the other end of the halyard;

raising the lighting fixture and the flag up the flagpole.

17. The method of claim 16 wherein the halyard includes an electrical cable, the lighting fixture is electrically connected to the electrical cable, and further comprising:

connecting the halyard to an electrical power source so that the lighting fixture is powered by the electrical power source.

18. A pole-suspended flag illumination system comprising:

a halyard having an anchored end and a non-anchored end, the anchored end of the halyard being adapted to attach to an anchor point on a flagpole;

one or more flag fasteners attached to the non-anchored end of the halyard;

a lighting fixture adapted to slidingly mount on the flagpole, wherein the lighting fixture is attached to the non-anchored end of the halyard and the lighting fixture is adapted to slide up and down along the flagpole with the non-anchored end of the halyard.

19. The pole-suspended flag illumination system of claim 18 wherein the lighting fixture is powered by an electrical cable connected to a power source.

20. The pole-suspended flag illumination system of claim 18 wherein the halyard includes an electrical cable and the lighting fixture is powered by the electrical cable connected to a power source.

* * * * *